United States Patent [19]

Socha

[11] Patent Number: 4,462,323

[45] Date of Patent: Jul. 31, 1984

[54] PRESSER FOOT LIFT FOR NEEDLE FEED IN A SEWING MACHINE

[75] Inventor: Robert J. Socha, Edison, N.J.

[73] Assignee: The Singer Company, Stamford, Conn.

[21] Appl. No.: 497,462

[22] Filed: May 23, 1983

[51] Int. Cl.[3] ..... D05B 29/02; D05B 27/20; D05B 3/02

[52] U.S. Cl. ..... 112/239; 112/158 R; 112/321

[58] Field of Search ..... 112/237, 239, 321, 158 E, 112/158 R

[56] References Cited

U.S. PATENT DOCUMENTS

| | | | |
|---|---|---|---|
| 2,754,783 | 7/1956 | Scott et al. | 112/237 |
| 2,864,327 | 12/1958 | Cole et al. . | |
| 3,040,682 | 6/1962 | Leslie . | |
| 3,561,382 | 2/1971 | Ketterer et al. . | |
| 3,688,712 | 9/1972 | Edwards . | |
| 3,730,117 | 5/1973 | Ritter et al. . | |
| 4,123,981 | 11/1978 | Brown | 112/321 X |
| 4,372,237 | 2/1983 | Totino et al. . | |
| 4,388,886 | 6/1983 | Adams . | |

FOREIGN PATENT DOCUMENTS

| | | |
|---|---|---|
| 41-472824 | 5/1966 | Japan . |
| 55-133971 | 9/1980 | Japan . |

*Primary Examiner*—Peter P. Nerbun

*Attorney, Agent, or Firm*—Edward P. Schmidt; Robert E. Smith; Edward L. Bell

[57] ABSTRACT

A means for selectively elevating a presser foot out of pressure contact with a work material when a sewing needle extends through the work material. The device includes a needle bar lever pivotally supported by the sewing machine frame and having an operative connection to the endwise shiftable needle bar for implementing oscillation thereof. A lug extending from the needle bar lever may cooperate with the second end of a lift lever having a first end operatively connected with the presser foot of the sewing machine. The lift lever is carried on a selectively shiftable pintle supported by the sewing machine frame, the pintle having a first shiftable position in which the lug extending from the needle bar lever does not engage with the second end of the lift lever and a second shiftable position in which the lug does engage with the second end of the lift lever whereby the lug will effect rotation of the lift lever and have the first end elevate the presser foot out of pressure contact with the work material.

7 Claims, 3 Drawing Figures

PRESSER FOOT LIFT FOR NEEDLE FEED IN A SEWING MACHINE

DESCRIPTION

Background of the Invention

This invention relates to sewing machine; more particularly, to a device particularly for an electronically controlled sewing machine to elevate the presser foot while the sewing needle is engaged with the work material in order to enable the sewing needle to implement a lateral motion of the work material.

It is known in the prior art to obtain lateral feed of a work material by laterally shifting the sewing needle while it is engaged with a work material. Such a teaching is disclosed in the Japanese Patent Publication No. 27028/65 of Janome, which was published on Nov. 26, 1965, and which disclosed in addition to the usual longitudinal feeding capability, a lateral feeding capability implemented by the sewing needle when in engagement with a work material. Further prior art is found in the U.S. Pat. No. 3,561,382 of Ketterer et al, which issued on Feb. 9, 1971. This patent discloses the use of a spcial cam to implement shifting of the sewing needle while in engagement with a work material to obtain a lateral feeding thereof.

Additional prior art is found in the U.S. Pat. No. 4,123,981 of Brown, which refers to means of obtaining needle feed in an electronically controlled sewing machine. In this patent it is disclosed that for certain ornamental patterns, the bight and feed information may be interchanged to obtain a lateral pattern having certain ornamental characteristics. It is further taught in that patent that in order to facilitate feed by the sewing needle, an even feed attachment as described in the U.S. Pat. No. 3,730,117 may be substituted for the presser foot in order to enable the needle to laterally shift the work material with the least resistance while still providing support for the work material against the thrust of the sewing needle into and out of the work material. The even feed attachment is supported by the presser bar of the sewing machine, which presser bar is set at a darn setting in order to obtain the lowest possible force on the attachment. The even feed attachment is actuated by the needle bar to urge a feed foot portion thereof against the work material during needle penetration and withdrawal, but reduces the pressure on the work material during the time of lateral feeding thereof. Thus, with the even feed attachment, the force that the attachment exerts upon the work material is at a minimum at the time of lateral feed to implement lateral feeding of the work material.

In order to implement an ornamental pattern in which both longitudinal and lateral feeding take place, it would be advantageous to have a device in which the presser foot pressure may be optimized during the longitudinal feeding of the work material, and the presser foot pressure may be minimized or eliminated during the time of lateral feeding of the work material. Ideally, such a device would be effective for use in an electronically controlled sewing machine since the potential for the greatest ornamentation capability exists in such a sewing machine.

SUMMARY OF THE INVENTION

The above desired ends are obtained in a sewing machine having a frame including a work supporting bed, and having a needle bar supported for endwise reciprocation and lateral oscillation in the frame. A sewing needle is carried in the end of the needle bar, which needle bar extends adjacent a presser bar having a presser foot carried in the end thereof for urging a work material against feeding means carried within the work supporting bed of the sewing machine. A pin is attached to the presser bar and extends therefrom adjacent a platform on a first end of a lift lever pivotally supported by the sewing machine frame on a selectively laterably shiftable pintle. The sewing machine frame also pivotally supports a needle bar lever having a driving connection to the needle bar, for oscillation therewith. The needle bar lever is fashioned with a lug extending therefrom and engageable with a second end of the lift lever in one selectable lateral shiftable position thereof. A latch lever has one end thereof pivotable on the sewing machine frame and the other end attached to a solenoid, for example, by a link. The latch lever extends adjacent the shiftable pintle of the lift lever and, when the solenoid is energized, shifts the lift lever to a position in which the lug or the needle bar lever engages with the second end of the lift lever to rotate the same and elevate the pin, presser bar and presser foot attached to the end thereof out of contact with the work material when the sewing needle is in engagement with the same. Thus, the sewing needle may shift the work material without the resistance normally encountered to the shifting motion by the presser foot. With the device included in an electronically controlled sewing machine, an electrical signal may be derived from the electronic control to actuate the solenoid when lateral feeding is to be implemented by the sewing machine, alone or as part of an ornamental pattern having both longitudinal and lateral feed components.

DESCRIPTION OF THE DRAWINGS

A further understanding of the invention and the manner in which it may be implemented may be had by reference to the accompanying drawings in which:

Referring to FIG. 1, there is shown a portion of a sewing machine 10 including a portion bracket arm 12 terminating in a head end 14 which extends over a work supporting bed 16. Visible in the head end 14 is a needle bar 18 which is supported for endwise reciprocation in a lower spherical bearing 20 carried in socket (not shown) in the sewing machine frame, and in the upper spherical bearing 22 carried in a socket in the end of a gate 24 pivoted on the sewing machine frame on a pin 26. A link 28 is pivotally connected to the gate 24 by a shouldered screw 29 and extends to a linear motor 30 or other device for initiating selected excursions of the needle bar 18, and the sewing needle 19 attached to the end thereof, in the formation of ornamental stitches. A control arrangement 32 is schematically illustrated as connected to the linear motor 30 to implement selected excursions of the sewing needle 19 in the formation of ornamental stitching. The control arrangement 32 may also be connected to a similar linear motor (not shown)

Figure 1:
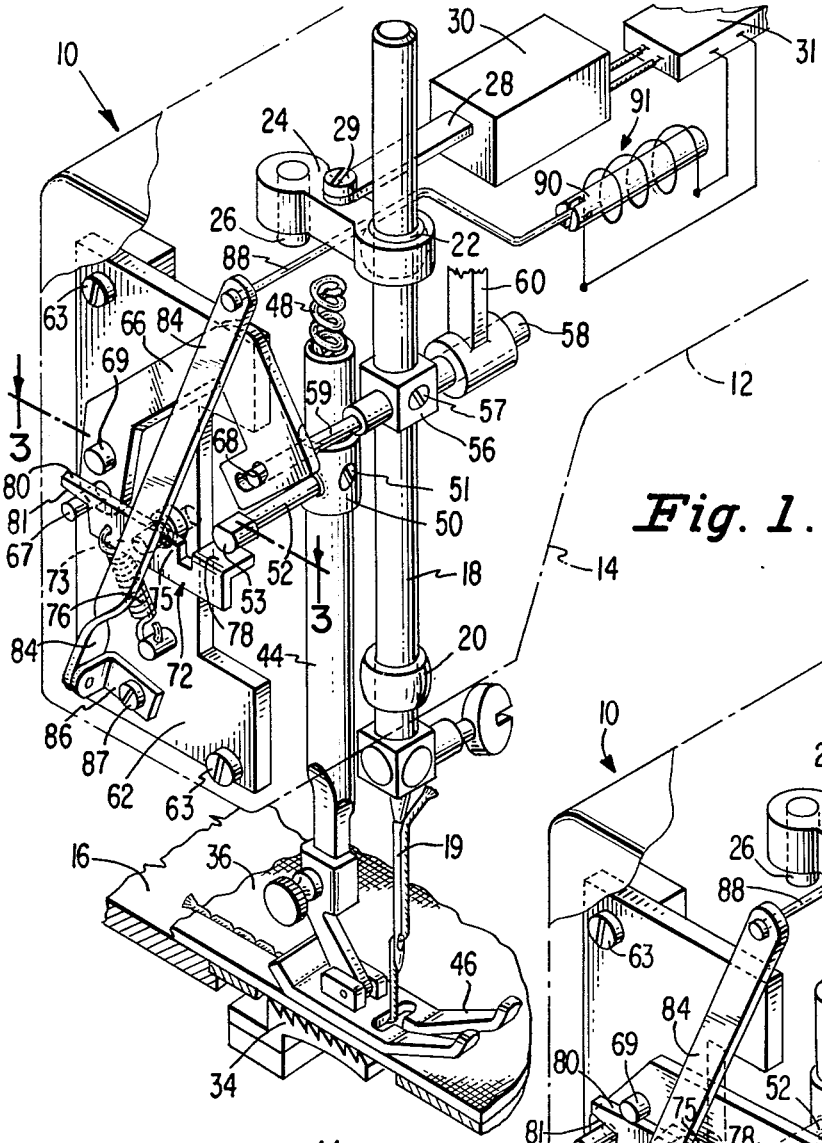
FIG. 1 is a perspective view of a portion of a sewing machine shown in phantom to disclose details of contruction of the device which is shown in an inoperative operative position.

used to regulate a feed system (not shown) supported in the bed 16 and terminating in the feeding dog 34 which extends through the bed to contact the work material 36 supported thereon so as to feed the work material longitudinally to form the series of stitches shown in FIG. 1.

Supported by the frame of the sewing machine 10 behind the needle bar 18 is a presser bar 44. Attached to the end of the presser bar 44 is a presser foot 46, the presser bar and presser foot urging the work material 36 against the feeding dog 34 by means of a spring 48 extending between the frame of the sewing machine 10 and the presser bar 44. A collar 50 is adjustably carried on the presser bar 44, and may be locked in an adjusted position by screw 51 extending therethrough. A pin 52 is affixed to the collar 50 and extends laterally therefrom to terminate in a head 53 spaced from the collar. The purpose for the pin 52 and the head 53 thereon will be explained below.

The needle bar 18 carries a driving collar 56 slidable thereon to an adjusted position which is retained by means of the screw 57. A stud 58 extends inwardly towards the bracket arm 12 through one end of a connecting link 60, the other end of which (not shown) is connected to a crank (not shown) for influencing endwise reciprocation of the needle bar 18 in a manner well known to any person skilled the art of sewing machines. A rod 59 extends from the driving collar 56 oppositely from the stud 58 thereof. The purpose for this rod 59 will be explained below.

Attached to the head end 14 by screws 63 is a support bracket 62 which is aligned substantially normally to the rod 59 of the driving collar 56. A needle bar lever 66 has one end thereof pivoted on a pivot pin 67 extending from, and deriving support from, the support bracket 62. The needle bar lever 66 is in the shape of an inverted U and extends forwardly over the top of the head 53 of pin 52, to provide clearance therefor, and is fashioned with a slot 68 in its forward end, in which extends rod 59 so that the needle bar lever undergoes vertical oscillation as the needle bar 18 undergoes endwise reciprocation. Any lateral oscillation of the needle bar is accommodated by the length of the rod 59 which extends through the slot 68 in the needle bar lever 66, so as not to have the lateral oscillations of the needle bar interfere with vertical oscillation of the needle bar lever. The needle bar lever 66 is fashioned with a set out or lug 69, whose purpose shall be explained below.

Figure 2:
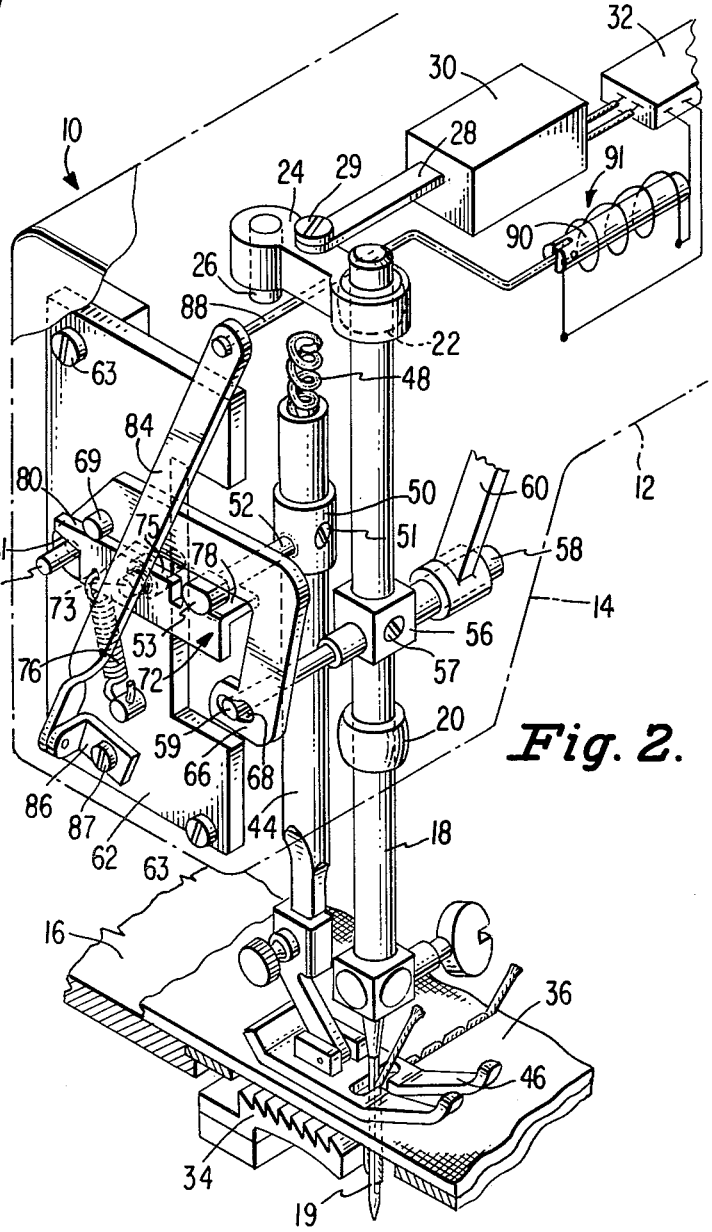
FIG. 2 is a perspective view similar to FIG. 1 with, however, the device shown in an operative position; and, FIG. 3 is a cross-section of the mechanism shown in FIG. 1 taken along the line 3—3 thereof.
Figure 3:
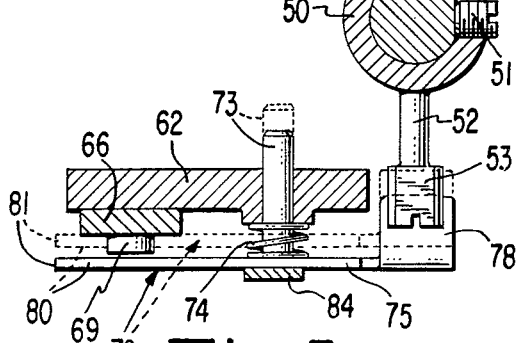

The support bracket 62 also pivotally supports thereon a sheet metal lift lever 72 which has extending therefrom substantially centrally thereof a pintle 73 which is slidably received in the support bracket (see also FIG. 3). Between the lift lever 72 and the support bracket 62, the pintle 73 supports a light compression spring 74 which serves to normally displace the lift lever in a first position away from the support bracket. The lift lever 72 extends forwardly from the pintle 73 to a first end 75, and the sheet metal material of the lift lever is bent over to form a platform 78 beneath the head 53 of the pin 52 attached to the presser bar 44 through the collar 50. A second end 80 of the lift lever extends rearwardly adjacent the needle bar lever 66 and beneath the lug 69 thereof when the lift lever 72 is shifted inwardly to a second position to compress the compression spring 74. The oscillation of the needle bar lever 66, occasioned by endwise reciprocation of the needle bar 18 will, in this second position of the lift lever 72, cause the lift lever 72 to rotate slightly after the sewing needle 19 of the needle bar 18 has extended through the work material 36, so as to elevate the presser foot 46 affixed to the end of the presser bar out of pressure contact with the work material 36 to enable lateral shift thereof. Such a condition is shown in FIG. 2, where the lug 69 impinges in the second end 80 of the lift lever 72, to cause the platform 78 on the first end thereof to abut the head 53 of pin 52 connected to the presser bar 44 to elevate the same. By proper design, the lug 69 may be located on the needle bar lever 66 in a position to rotate the lift lever 72 when the sewing needle 19 extends substantially through the work material 36 and before the control arrangment 32 signals the linear motor 30 to begin the lateral excursion which will result in lateral shift of the work material as shown in FIG. 2. Of course, the lift lever 72 remains rotated to keep the presser foot 46 elevated until all lateral motion by the linear motor 30 has been completed.

In order to shift the lift lever 72 to the second position against the urgings of the compression spring 74, a latch lever 84 is provided which is pivoted on a pin carried by hinge bracket 86 attached to the support bracket 62 by screw 57. The latch lever 84 extends across the lift lever 72 where it is attached to the pintle 73 in order to obtain the most direct action without cocking of the lift lever. The end of the latch lever 84 opposite that pivoted on the hinge bracket 86 is connected to the end of a link 88 which extends to the armature 90 of a solenoid 91. When the solenoid 91 is activated by the control arrangement 32, to which its leads are connected, the armature 90 thereof is pulled in to draw in the latch lever 84 through the link 88. This drawing in of the latch lever 84 displaces the lift lever 72 against the urgings of the compression spring 74 so as to place the second end 80 thereof in the path of motion of the lug 69 on the needle bar lever 66. This action may be timed by the control arrangement 32 to take place while the needle bar 18 is in a elevated position. Thereafter, as the needle bar 18 proceeds downwardly, the rod 59 carried thereby will draw the needle bar lever 66 clockwise as viewed in FIGS. 1 and 2 to bring the lug 69 thereof into in engagement with the second end 80 of the lift lever 72. The lift lever 72 will rotate counterclockwise and the platform 78 thereof will abut the head 53 of pin 52 attached to the presser bar 44 to elevate the same and the presser foot 46 attached to the end thereof out of intimate contact with the work material 36. Thereafter, the needle bar 18 and sewing needle 19 which extends through the work material 36 may be shifted by the linear motor 30 in order to effect a lateral shift of the work material. As the needle bar 18 draws upwardly to remove the sewing needle 19 from the work material 36, the lug 69 of the needle bar lever 66 is lifted from the second end 80 of the lift lever 72, and the force of the spring 48 on the presser bar 44 will return the presser foot 46 into intimate contact with work material 36. An extension spring 76 attached to the second end 80 of the lift lever 72 operates to maintain the platform 78 of the lift lever in contact with the head 53 of pin 52 at all times. If the presser bar 44 is elevated by the usual presser bar lifting lever (not shown), the lift lever 72 is prevented from undergoing undue counterclockwise motion under the urgings of the extension spring 76, by the tail 81 on the second end 80 of the lift lever which engages with the extension to the pivot pin 67 to prevent this further counterclockwise motion.

Referring to FIG. 3, there is shown the attachment of the lift lever 72 to the pintle 73, and the support of the pintle 73 in the support bracket 62 in a fashion to permit axial shift thereof. The compression spring 74 which encircles the pintle 73 operates on the lift lever 72 to urge the lift lever outwardly to a position where the second end 80 thereof does not cooperate with the lug 69 on the needle bar lever 66. The latch lever 84 engages the lift lever 72, and when the solenoid 91 is activated by the control arrangement 32, and the lift lever 72 and the pintle 73 are urged to the position shown in phantom, in which the second end 80 of the lift lever is placed in the path of motion of the lug 69 of the needle bar lever 66 as the needle bar 18 reciprocates. When disposed as shown in phantom, the lift lever 72 operates to elevate the presser bar 44 and the presser foot 46 affixed to the end thereof while the sewing needle is in engegement with the work material 36, so that lateral shifting of the work material may be implemented by the sewing needle.

The present invention, therefore, provides for the selective lateral feeding of a work material in a sewing machine which might also have longitudinal feeding capability. The selective lateral feeding may be implemented automatically by an electronic control arrangement or by a mechanical cam actuated arrangement as part of an ornamental pattern having the work material fed in any direction. In a mechanical cam actuated arrangement, for example, the latch lever 84 may be rotated, through the link 88, by a cam follower - rocker arm, which responds to cam lobes on a lateral shift cam to shift the link 88 and the latch lever. The lateral shift cam may be timed to a bight cam and longitudinal feed cam in order to obtain an ornamental pattern having the capability to feed work material in any direction. With the device herein disclosed, a standard presser foot 46 may be utilized at an optimum pressure for the work material being operated upon, and for the speed with which stitching is taking place during longitudinal feeding. This device enables the pressure exerted by the presser foot on the work material to be reduced to a minimum or zero during the time of lateral feeding of the work material in order to implement the same. Thus, with this device a complex ornamental pattern may be implemented in which longitudinal feeding takes place at an optimum pressure, and in which lateral feeding takes place also at an optimum pressure. It will be appreciated that other modifications, substitutions, omissions and variations may be made to the present invention without departing from the spirit of the invention.

I claim:

1. A sewing machine comprising a frame including a work supporting bed, a needle bar supported by said frame for endwise reciprocation and lateral oscillation, a sewing needle carried on the end of said needle bar, a presser foot, means for urging said presser foot against a work material supported on said work supporting bed with an optimum pressure for said work material and sewing conditions, said means including a presser bar slidably supported by said frame and having said presser foot on the lower end thereof, and means for selectively elevating said presser foot out of pressure contact with said work material when said sewing needle extends through said work material.

2. A sewing machine as claimed in claim 1, wherein said selective elevating means further comprises:

a lift lever having a first and second end and pivotably supported by said frame with said first end in operative engagement with said presser foot for selective elevation of the same out of pressure contact with said work material;

means responsive to endwise reciprocation of said needle bar for selectively contacting said second end of said lift lever to implement the selective elevation of said presser foot out of pressure contact with the work material.

3. A sewing machine as claimed in claim 2, wherein said contacting means further comprises:

a needle bar lever having one end pivotably carried by said frame, and the other end operatively connected to said needle bar, whereby endwise reciprocation of said needle bar will influence oscillation of said needle bar lever, said needle bar lever further including a lug extending therefrom selectively engageable with said second end of said lift lever when said sewing needle extends through said work material.

4. A sewing machine as claimed in claim 3, wherein said lift lever further comprises a pintle extending transversely thereof between said first and said second end;

said selective elevating means further comprising means for shiftably supporting said pintle, and said lift lever, in a first position in which said lug extending from said needle bar lever does not engage with said second end of said lift lever and in a second position where said lug does engage with said second end of said lift lever, and means for selecting one of said first and second positions.

5. A sewing machine as claimed in claim 4, wherein said supporting means is implemented by a compression spring supported upon said pintle adjacent said lift lever and an aperture in said frame for shiftably receiving said pintle with said compression spring extending between said lift lever and said frame, whereby said compression spring influences a shift of said lift lever and pintle to a first position in which said lug extending from said needle bar does not engage with said second end of said lift lever.

6. A sewing machine as claimed in claim 5, wherein said shifting means is implemented by a latch lever having one end pivotably supported by said sewing machine frame and extending transversely across said lift lever adjacent said pintle thereof, a link connected to the other end of said latch lever, and an actuating means connected to said link, whereby actuation of said actuating means shifts said link to initiate rotation of said latch lever so as to have the same bear against said lift lever and shift the pintle thereof from said first position to said second position where said lug does engage said second end of said lift lever when said sewing needle extends through said work material.

7. A sewing machine comprising a frame including a work supporting bed, a needle bar supported by said frame for endwise reciprocation and lateral oscillation, a sewing needle carried on the end of said needle br, a presser foot, means for urging said presser foot against a work material supported on said work supporting bed, said means including a presser bar slidably supported by said frame and having said presser foot on the lower end thereof, and means for selectively elevating said presser foot out of pressure contact with said work material when said sewing needle extends through said work material;

a pin attached to said presser bar extending therefrom, a lift lever pivotably supported by said frame on a selectively shiftable pintle and having a first end contiguous said pin, a needle bar lever pivotally supported by said frame and having a driving connection to said needle bar, said needle bar lever having a lug extending therefrom for engagement with a second end of said lift lever in one selected shiftable position of said lift lever, means for shifting said selectively shiftable pintle from a first position in which said lug extending from said needle bar lever does not engage said second end of said lift lever, to a second position where said lug does engage said second end of said lift lever when said sewing needle extends through said work material, whereby said lug will effect rotation of said lift lever and have said first end elevate said pin and thereby said presser bar to lift said presser foot out of pressure contact with said work material.

* * * * *